US011239023B2

(12) United States Patent
Kitatani et al.

(10) Patent No.: US 11,239,023 B2
(45) Date of Patent: Feb. 1, 2022

(54) WINDING PART

(71) Applicant: TDK Corporation, Tokyo (JP)

(72) Inventors: Kazuharu Kitatani, Tokyo (JP); Kiyomi Yamazaki, Tokyo (JP); Tomokazu Ikarashi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 701 days.

(21) Appl. No.: 16/136,430

(22) Filed: Sep. 20, 2018

(65) Prior Publication Data

US 2019/0164687 A1 May 30, 2019

(30) Foreign Application Priority Data

Nov. 24, 2017 (JP) ..... JP2017-225361

(51) Int. Cl.

| | |
|---|---|
| ***H01F 27/32*** | (2006.01) |
| ***H01F 5/00*** | (2006.01) |
| ***H01F 27/26*** | (2006.01) |
| ***H01F 27/24*** | (2006.01) |
| ***H01F 27/29*** | (2006.01) |
| ***H01F 5/02*** | (2006.01) |
| *H01F 5/04* | (2006.01) |

(52) U.S. Cl.

CPC ..... *H01F 27/325* (2013.01); *H01F 5/02* (2013.01); *H01F 27/24* (2013.01); *H01F 27/29* (2013.01); *H01F 27/266* (2013.01); *H01F 2005/043* (2013.01)

(58) Field of Classification Search

CPC ..... H01F 27/325; H01F 27/266; H01F 5/02; H01F 2005/043

See application file for complete search history.

(56) References Cited

U.S. PATENT DOCUMENTS 5,696,477 A 12/1997 Yamamori et al.
6,525,637 B1 * 2/2003 Van Gestel ..... H01F 27/325 336/192

(Continued)

FOREIGN PATENT DOCUMENTS

CN 202749209 U 2/2013
CN 109841391 A 6/2019

(Continued)

OTHER PUBLICATIONS

Chinese Office Action issued in corresponding Chinese Application No. 201811129907.2, dated Sep. 21, 2020 (6 pages).

(Continued)

*Primary Examiner* — Elvin G Enad
*Assistant Examiner* — Malcolm Barnes
(74) *Attorney, Agent, or Firm* — Flynn Thiel, P.C.

(57) ABSTRACT

A highly reliable winding part is provided which is capable of providing insulation with reliability. A core is attached to a bobbin along a first direction. First terminals and second terminals are disposed along the first direction. A first terminal group and a second terminal group are disposed with the core interposed between the groups. A first insulation portion or a recess along a second direction that is not parallel to the first direction is provided between the first terminals and the second terminals, and a second insulation portion or a core groove along the first direction is provided between the first terminal group and the second terminal group.

4 Claims, 4 Drawing Sheets

(56) References Cited

U.S. PATENT DOCUMENTS

| | | | | |
|---|---|---|---|---|
| 6,559,749 | B1 * | 5/2003 | Weiner | H01F 5/04 336/192 |
| 8,269,593 | B2 | 9/2012 | Tsai et al. | |
| 8,570,768 | B2 | 10/2013 | Quek | |
| 9,837,194 | B1 | 12/2017 | Folker et al. | |
| 2005/0275498 | A1 * | 12/2005 | Haga | H01F 41/076 336/208 |
| 2006/0244561 | A1 * | 11/2006 | Iwakura | H01F 27/325 336/212 |
| 2007/0126542 | A1 * | 6/2007 | He | H01F 27/027 336/83 |
| 2011/0037554 | A1 | 2/2011 | Tsai et al. | |
| 2011/0043315 | A1 | 2/2011 | Kobayashi et al. | |
| 2011/0193673 | A1 | 8/2011 | Tsai et al. | |
| 2011/0199176 | A1 * | 8/2011 | Tada | H01F 27/06 336/192 |
| 2012/0223799 | A1 * | 9/2012 | Hester | H01F 27/30 336/220 |
| 2013/0169400 | A1 * | 7/2013 | Kim | H01F 27/2823 336/192 |
| 2014/0266540 | A1 | 9/2014 | Yang | |
| 2015/0116068 | A1 | 4/2015 | Kwon et al. | |
| 2015/0137928 | A1 * | 5/2015 | Wakibayashi | H01F 27/292 336/192 |
| 2019/0164688 | A1 | 5/2019 | Kitatani et al. | |

FOREIGN PATENT DOCUMENTS

| | | | | |
|---|---|---|---|---|
| JP | 61196512 | U | | 12/1986 |
| JP | 62125610 | A | | 6/1987 |
| JP | 63228705 | A | | 9/1988 |
| JP | 476023 | U | | 7/1992 |
| JP | 669051 | A | | 3/1994 |
| JP | 06069051 | A | * | 3/1994 |
| JP | 864435 | A | | 3/1996 |
| JP | 08064435 | A | * | 3/1996 |
| JP | 8-306550 | A | | 11/1996 |
| JP | 3184261 | U | * | 6/2013 |
| JP | 3184261 | U | | 6/2013 |
| JP | 2019096749 | A | | 6/2019 |
| TW | 201128665 | A1 | | 8/2011 |

OTHER PUBLICATIONS

Notice of Reasons for Refusal issued in corresponding Japanese Patent Application No. 2017-225361, with English translation, dated Aug. 27, 2021 (5 pages).

* cited by examiner

FIG. 2A
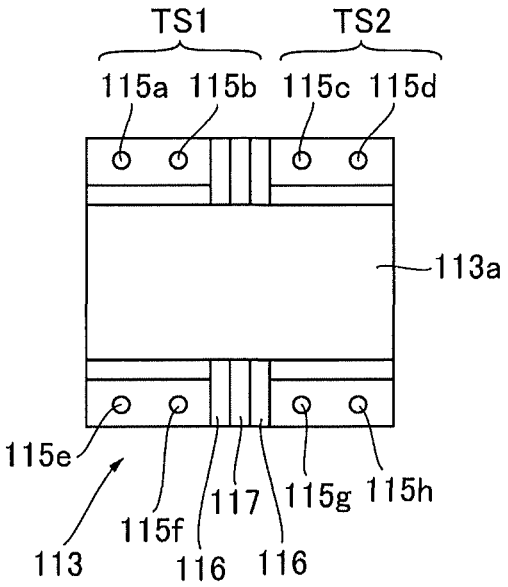
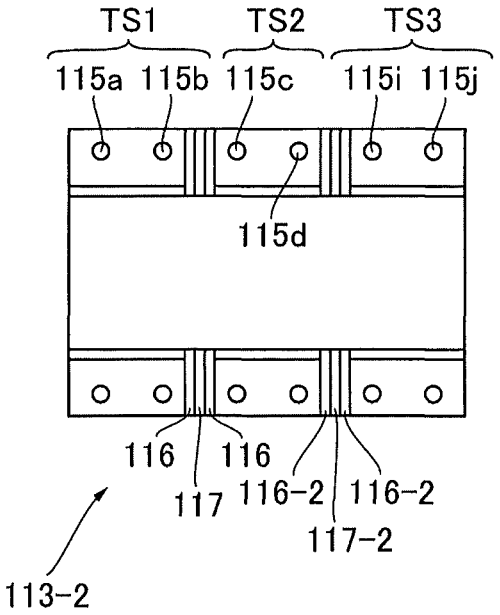
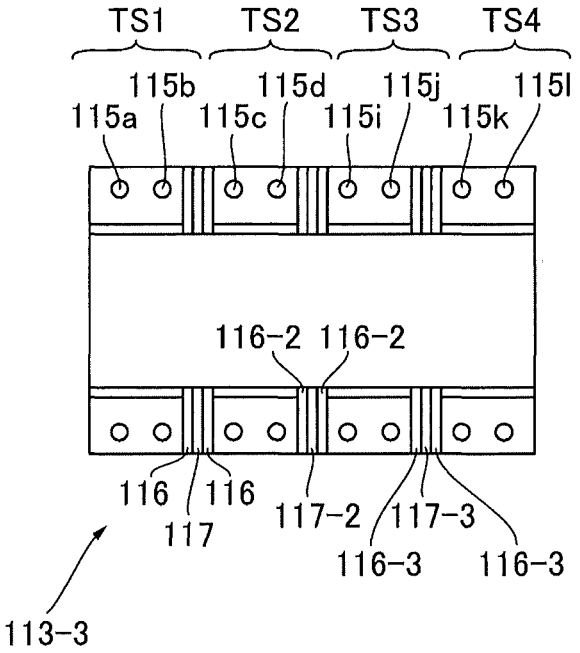
FIG. 2B
FIG. 2C

WINDING PART

CROSS-REFERENCE TO RELATED APPLICATION

This claims priority to Japanese Patent Application No. 2017-225361 filed Nov. 24, 2017 which is hereby expressly incorporated by reference herein in its entirety.

BACKGROUND OF THE INVENTION

1. Field of the Invention

The present invention relates to a winding part.

2. Description of the Related Art

Conventionally known is a winding part/component having a winding structure (e.g., Bifilar winding) for winding a plurality of windings on a bobbin at the same time (see FIG. 3A of Japanese Patent Application Laid-Open No. Hei. 8-306550). Here, with four conductors extended downwardly from the bobbin, two adjacent conductors 2, 3 on the left (the symbols as used in Japanese Patent Application Laid-Open No. Hei. 8-306550) are the start of windings and the two adjacent conductors 2, 3 on the right are the end of the windings.

However, with decreasing size of winding parts, it has been difficult to provide winding parts with an insulation distance ensured between the terminals to which different windings are connected. Like the winding part disclosed in Japanese Patent Application Laid-Open No. Hei. 8-306550, when the winding part is reduced in size by an automatic winding machine winding a plurality of windings on a bobbin, the distance between the terminals provided on the bobbin (the terminal-to-terminal distance between the terminals connected to the winding start conductors or the terminals connected to the winding end conductors) may have to be ensured for the nozzles of the automatic winding machine to work. However, as the size of the winding part has been reduced, it is difficult to ensure the insulation distance between the terminals to which different windings are connected. In particular, for a winding part provided with a plurality of windings, an insulation distance has to be ensured for insulation between the terminals to which different windings are connected. To this end, the insulation distance between the terminals to which different windings arranged in the same direction as that of the core are connected had to be ensured, and at the same time, the insulation distance between the terminals to which different windings positioned in a direction different from that of the core are connected had to be ensured.

SUMMARY OF THE INVENTION

In this context, the present invention has been developed to address the problems mentioned above. It is therefore an object of the invention to provide a highly reliable winding part which is capable of providing insulation with reliability.

To solve the problems mentioned above, the present invention provides a winding part including: a bobbin; a core attached to the bobbin; first terminals secured to the bobbin and connected to a first winding; and second terminals secured to the bobbin and connected to a second winding that is required to be insulated from the first winding. In this winding part, the core is attached to the bobbin along a first direction, the first terminals and the second terminals are disposed along the first direction, at least part of the first terminals and the second terminals constitutes a first terminal group disposed on one side of the core in plan view and a second terminal group disposed on the other side of the core in plan view, a first insulation portion along a second direction that is not parallel to the first direction is provided between the first terminals and the second terminals of the bobbin, and a second insulation portion along the first direction is provided between the first terminal group and the second terminal group.

As described above, the first insulation portion along the second direction that is not parallel to the first direction is provided between the first terminals and the second terminals, while the second insulation portion along the first direction is provided between the first terminal group and the second terminal group. This enables an insulation distance to be ensured between the terminals to which different windings are connected and which are arranged in the same direction as that of the core, while enabling an insulation distance to be ensured between the terminals to which different windings are connected and which are positioned in a direction different from that of the core. It is thus possible to efficiently ensure an insulation distance (a creepage distance and/or a spatial distance) between the terminals to which different windings are connected and between both terminal groups.

Furthermore, in the winding part according to the present invention described above, the second insulation portion includes a core groove for use in disposing the core.

Such a configuration enables the core groove for use in disposing the core to be also used as the second insulation portion for ensuring an insulation distance between the first terminal group and the second terminal group. This contributes to reduce the size of the winding part itself and makes it possible to ensure the insulation distance with reliability.

Furthermore, in the winding part according to the present invention described above, the first insulation portion is constructed by forming part of the bobbin in either of a concave shape and a convex shape.

Such a configuration enables the insulation distance, in particular, the creepage distance to be ensured.

Furthermore, in the winding part according to the present invention described above, the first insulation portion includes a fitting member configured to mate with the concave shape or the convex shape.

Such a configuration further makes it possible to ensure the insulation distance, in particular, the spatial distance.

Furthermore, in the winding part according to the present invention described above, the fitting member is formed to integrally include the first insulation portion and the second insulation portion, and further includes a locking part so as to be secured to the bobbin by the locking part.

Such a configuration provides the effects that one fitting member ensures with reliability the insulation distance between the first terminals and the second terminals and between the first terminal group and the second terminal group, also contributing to simplifying manufacturing.

By applying the present invention, it is possible to provide a highly reliable winding part that can provide insulation with reliability.

BRIEF DESCRIPTION OF THE DRAWINGS

FIGS. 1A and 1B illustrate a winding part according to a first embodiment to which the present invention is applied, wherein FIG. 1A is a perspective view and FIG. 1B is a side view;

FIGS. 2A, 2B, and 2C illustrate schematic bottom configuration diagrams of a winding part, wherein FIG. 2A is a schematic bottom configuration diagram of the winding part of the first embodiment as shown in FIGS. 1A and 1B, and FIGS. 2B and 2C are schematic bottom configuration diagrams illustrating other variations;

FIGS. 3A and 3B illustrate a winding part according to a second embodiment to which the present invention is applied, wherein FIG. 3A is a perspective view and FIG. 3B is a side view; and FIGS. 4A and 4B illustrate a winding part according to a third embodiment to which the present invention is applied, wherein FIG. 4A is a perspective view and FIG. 4B is a side view.

DETAILED DESCRIPTION OF THE PREFERRED EMBODIMENTS

Figure 1B:
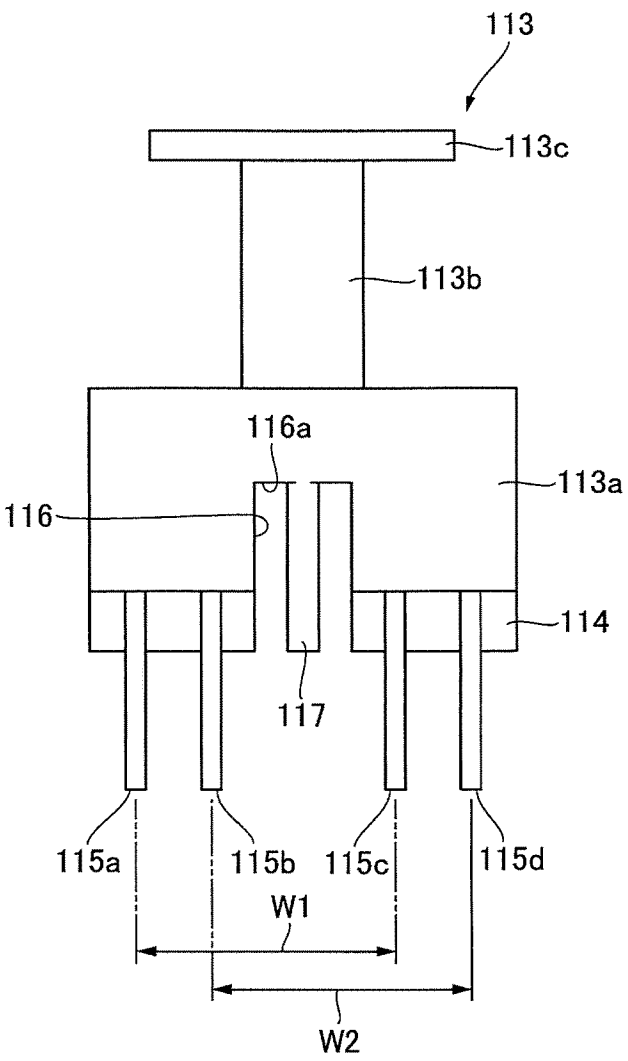

With reference to the attached drawings, a description will be given of a winding part according to an embodiment according to the present invention. For the sake of ease of understanding of the drawings, the size and dimensions of each component are partly emphasized, and hence do not necessarily coincide with those of actual products at some portions. Each drawing is viewed in the orientation of reference numerals, and up and down, left and right, front and back are represented on the basis of the orientation.

[Configuration of Winding Part]

Figure 1A:
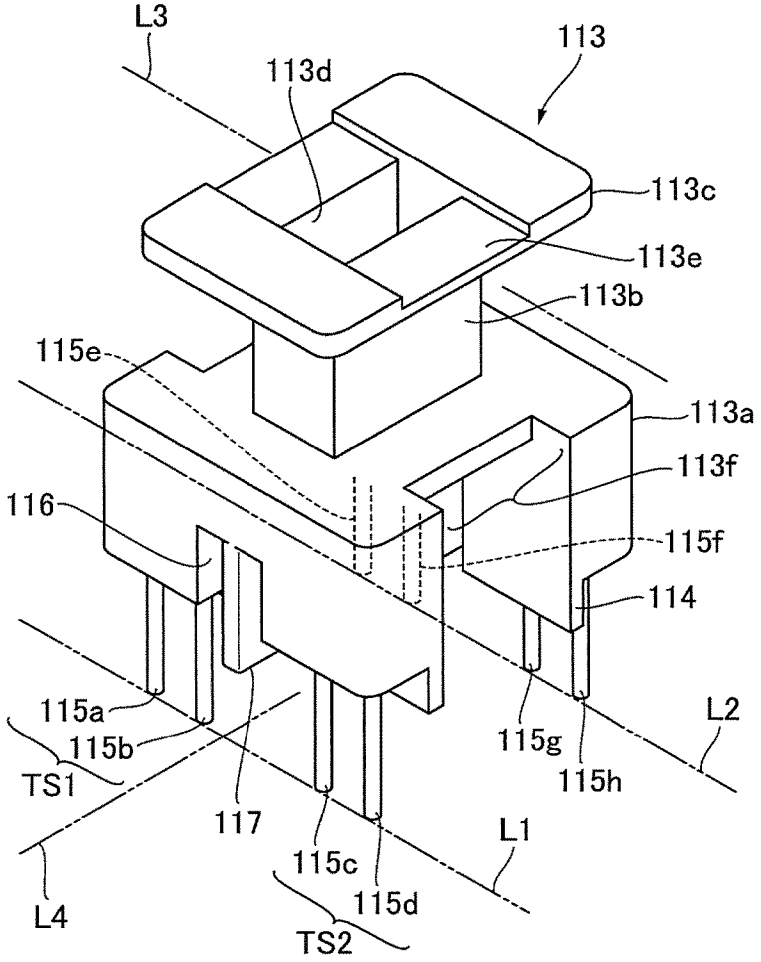

FIGS. 1A and 1B illustrate a transformer (an example of a winding part) which includes a bobbin 113, and a winding and a magnetic core (not illustrated in the figure) attached to the bobbin 113.

The bobbin 113 includes, as essential components, a main body 113*a* having eight terminals (115*a* to 115*h*) on the bottom; a column 113*b* which is provided on top of and generally at the center of the main body 113*a* and around which a winding (not illustrated in the figure) is wound; and a flange 113*c* which is provided on the upper end of the column 113*b*. The column 113*b* is formed in a cylindrical shape having a hollow 113*d* extending in the vertical direction. The magnetic core is attached so as to sandwich the column 113*b* in the vertical direction (see also FIGS. 3A and 3B) and is mounted in a manner such that part of the magnetic core (e.g., the center column of an E-type core) is inserted into the hollow 113*d* inside the column 113*b*. Furthermore, the magnetic core is mounted along the direction of a step height groove 113*e* provided on the flange 113*c* (a first direction or L3 direction).

The main body 113*a* is provided with a core groove 113*f* for use in inserting the magnetic core therein in the same direction (L3) as that of the step height groove 113*e* of the flange 113*c*. Furthermore, four terminals are provided in a straight line on each of both sides of the core groove 113*f*, and thus, eight terminals 115*a* to 115*f* in total are provided in two rows (L1, L2) with the core groove 113*f* therebetween.

In front of the core groove 113*f* in FIG. 1A, the four terminals 115*a*, 115*b*, 115*c*, and 115*d* are disposed in a row (L1): the two terminals 115*a* and 115*b* thereof (the start of winding and the end of winding) on the left are first terminals to be connected to a first winding; and the two terminals 115*c* and 115*d* (the start of winding and the end of winding) on the right are second terminals to be connected to a second winding (the second winding being required to be insulated from the first winding). That is, the terminals are sequentially arranged in a row (L1) in the following order: "the first terminal 115*a* (one side of the first terminal), the first terminal 115*b* (the other side of the first terminal), the second terminal 115*c* (one side of the second terminal), and the second terminal 115*d* (the other side of the second terminal)."

Furthermore, in the rear of the core groove 113*f* in FIG. 1A, the four terminals 115*e*, 115*f*, 115*g*, 115*h* are disposed in a row (L2): the two terminals 115*e* and 115*f* thereof on the left are first terminals that can be connected to the first winding (the start of winding and the end of winding); and the two terminals 115*g* and 115*h* on the right are second terminals that can be connected to the second winding (the start of winding and the end of winding) (which is required to be insulated from the first winding). That is, here, the terminals are sequentially arranged in a row (L2) in the following order: "the first terminal 115*e*, the first terminal 115*f*, the second terminal 115*g*, and the second terminal 115*h*" (also see FIG. 2A).

Furthermore, when the two first terminals 115*a* and 115*b* disposed along L1 are collectively defined as a first terminal set TS1 and the two second terminals 115*c* and 115*d* are collectively defined as a second terminal set TS2, the main body 113*a* of the bobbin 113 is provided with a recess (first insulation portion) 116 between the first terminal set TS1 and the second terminal set TS2 in a direction L4 different from L1 (L2, L3) (a second direction: in this embodiment, a direction generally orthogonal to L1, L2, and L3). The recess 116 is formed so as to be opened toward the bottom of the bobbin 113 (so as to be recessed upward from the bottom), that is, in a manner such that a groove is placed upside down. Furthermore, the recess 116 is provided with a plate-shaped insulating plate (first insulation portion) 117 vertically from a recess bottom 116*a* along the direction L4 that is the same as that of the recess 116. Note that the length of the insulating plate 117 extends generally to the same position as that of the lower end of a skirt 114 that is brought into contact with the surface of a substrate (not illustrated in the figure) when the bobbin 113 is placed on the substrate. When the bobbin 113 is mounted on the substrate, the lower end of the insulating plate 117 is brought into contact with the substrate. On the other hand, the core is regarded as a floating conductor when an insulation distance is taken into account. Thus, the insulation distance between the first terminal set TS1 (115*a*, 115*b*) on one side of the core and the second terminal set TS2 (115*c*, 115*d* and/or 115*g*, 115*h*) on one side and/or the other side of the core is the sum of the distance from the surface on which the first terminal set TS1 is connected to the bobbin 113, via the skirt 114 from the first terminal set TS1, to the bottom surface (the surface toward the substrate surface) of the core inserted in the core groove 113*f* and the distance from the surface on which the second terminal set TS2 is connected to the bobbin 113, via the skirt 114 from the second terminal set TS2, to the bottom surface (the surface toward the substrate surface) of the core inserted in the core groove 113*f*. It is thus possible to ensure an insulation distance by means of the skirt 114 and the core groove 113*f*. Additionally, it is also possible to ensure an insulation distance between the first terminal set TS1 on the other side of the core (115*e*, 115*f*) and the second terminal set TS2 (115*c*, 115*d* and/or 115*g*, 115*h*) on the one side and/or the other side of the core.

Furthermore, as illustrated in FIG. 1B, each terminal is disposed in a manner such that the terminal-to-terminal distance W1 between the first terminal 115*a* (one side of the first terminal) and the second terminal 115*c* (one side of the second terminal) and the terminal-to-terminal distance W2 between the first terminal 115*b* (the other side of the first terminal) and the second terminal 115*d* (the other side of the second terminal) are the same as each other. This enables the automatic winding machine to wind a plurality of (two in this embodiment) windings at the same time. That is, when the first terminal 115*a* is selected as the start terminal of winding the first winding, the second terminal 115*c* is selected as the start terminal of winding the second winding. At the same time, the first terminal 115*b* is selected as the end terminal of winding the first winding and the second terminal 115*d* is selected as the end terminal of winding the second winding. That is, the automatic winding machine starts winding at the first terminal 115*a* and the second terminal 115*c* between which the terminal-to-terminal distance W1 is ensured, whereas the automatic winding machine ends winding at the first terminal 115*b* and the second terminal 115*d* between which the terminal-to-terminal distance W2 (the same as the terminal-to-terminal distance W1) is ensured. Thus, a sufficient terminal-to-terminal distance is ensured. In other words, by reducing these terminal-to-terminal distances W1 and W2 to the limit which allows the nozzles of the automatic winding machine to work, it is possible to reduce the mounting area of the bobbin 113 serving as a winding part. Note that as a matter of course, the automatic winding machine can operate when the start and end terminals of winding are reversed.

As described above, according to the present invention, the winding part includes: the bobbin 113; the core attached to the bobbin 113; the first terminals 115*a*, 115*b*, 115*e*, 115*f* which are secured to the bobbin 113 and connected to a first winding; and the second terminals 115*c*, 115*d*, 115*g*, 115*h* which are secured to the bobbin 113 and connected to a second winding that is required to be insulated from the first winding. The core is attached to the bobbin 113 along the first direction L3. The first terminals 115*a*, 115*b*, 115*e*, 115*f* and the second terminals 115*c*, 115*d*, 115*g*, 115*h* are provided along the first direction L3 (L1, L2). At least part of the first terminals 115*a*, 115*b*, 115*e*, 115*f* and the second terminals 115*c*, 115*d*, 115*g*, 115*h* constitutes the first terminal group (115*a*, 115*b*, 115*c*, 115*d*) disposed on one side of the core in plan view and the second terminal group (115*e*, 115*f*, 115*g*, 115*h*) disposed on the other side of the core in plan view. The first insulation portion (the recess 116 and the insulating plate 117) along a second direction L4 that is not parallel to the first direction L3 is provided between the first terminals 115*a*, 115*b*, 115*e*, 115*f* and the second terminals 115*c*, 115*d*, 115*g*, 115*h* of the bobbin 113. A second insulation portion that includes the skirt 114 disposed along the first direction L3 is provided between the first terminal group (115*a*, 115*b*, 115*c*, 115*d*) and the second terminal group (115*e*, 115*f*, 115*g*, 115*h*).

This makes it possible to ensure the insulation distance between the terminals (the first terminals 115*a*, 115*b* and the second terminals 115*c*, 115*d*) to which different windings are connected and arranged in the same direction as that of the core, and at the same time, to ensure the insulation distance between the terminal groups (the first terminal group (115*a*, 115*b*, 115*c*, 115*d*) and the second terminal group (115*e*, 115*f*, 115*g*, 115*h*)) to which different windings are connected and positioned in a direction different from that of the core. Thus, the insulation distances (the creepage distance and/or the spatial distance) between the terminals and between both the terminal groups to which different windings are connected are efficiently ensured. On the other hand, even when the first terminal and the second terminal are disposed in this order on one side of the core whereas the second terminal and the first terminal are disposed in this order on the other side of the core, the second insulation portion is capable of ensuring an insulation distance.

Furthermore, the second insulation portion includes the core groove 113*f* for use in disposing the core therein.

In addition to the skirt 114, such a configuration enables the core groove 113*f* for use in disposing the core to be employed also as the second insulation portion for ensuring the insulation distance between the first terminal group and the second terminal group (the distance from the first terminal set TS1 on one side of the core to the second terminal set TS2 on the one side of the core and/or the other side of the core, and the distance from the first terminal set TS1 on the other side of the core to the second terminal set TS2 on the one side of the core and/or on the other side of the core). This contributes to the reduction in size of the winding part itself and ensures the insulation distance with reliability.

Furthermore, the first insulation portion is constructed by forming part of the bobbin in a concave shape or convex shape.

Such a configuration enables the insulation distance, in particular, the creepage distance to be ensured.

Note that the automatic winding machine may be used not always to wind two windings at the same time but also to wind three or more windings at the same time. For example, as shown in FIG. 2B byway of example, in addition to the first terminals 115*a* and 115*b* connected to the first winding and the second terminals 115*c* and 115*d* connected to the second winding, third terminals 115*i* and 115*j* connected to all the windings up to the third one that are required to be each insulated from the first winding and the second winding are also protruded, at least two terminals for each winding. These terminals are sequentially arranged in a row in the following order: "the first terminal 115*a*, the first terminal 115*b*, the second terminal 115*c*, the second terminal 115*d*, the third terminal 115*i*, and the third terminal 115*j*." This arrangement also provides the same effects even in the case of three windings. Furthermore, when the two first terminals 115*a* and 115*b* are collectively defined as the first terminal set TS1, the two second terminals 115*c* and 115*d* are collectively defined as the second terminal set TS2, and the two third terminals 115*i* and 115*j* are collectively defined as a third terminal set TS3, a recess (116, 116-2) and an insulating plate 117, 117-2 may be provided between each of the terminal sets. This makes it possible to ensure a sufficient insulation distance (in particular, the creepage distance) between each terminal set and the next. It is thus possible to design a reduced distance between both terminal sets, with the result of constituting a winding part having a further reduced mounting area.

Furthermore, as shown in FIG. 2C by way of example, in addition to the first terminals 115*a* and 115*b* connected to the first winding and the second terminals 115*c* and 115*d* connected to the second winding, the third terminals 115*i* and 115*j* and fourth terminals 115*k* and 115*l* connected to all the windings up to the fourth one that are required to be insulated from the first winding and the second winding are also protruded, at least two terminals for each winding. These terminals are sequentially arranged in a row in the following order: "the first terminal 115*a*, the first terminal 115*b*, the second terminal 115*c*, the second terminal 115*d*, the third terminal 115*i*, the third terminal 115*j*, the fourth terminal 115*k*, and the fourth terminal 115*l*." This arrangement also provides the same effects even in the case of four windings. Furthermore, when the two first terminals 115*a* and 115*b* are collectively defined as the first terminal set TS1, the two second terminals 115*c* and 115*d* are collectively defined as the second terminal set TS2, the two third terminals 115*i* and 115*j* are collectively defined as the third terminal set TS3, and the two fourth terminals 115*k* and 115*l* are collectively defined as a fourth terminal set TS4, there may be provided a recess (116, 116-2, 116-3) and an insulating plate 117, 117-2, 117-3 between each of the terminal sets. This makes it possible to ensure a sufficient insulation distance (in particular, the creepage distance) between each terminal set and the next. It is thus possible to design a reduced distance between both the terminal sets, with the result of constituting a winding part having a reduced mounting area.

[Another Example Configuration]

Figure 3B:
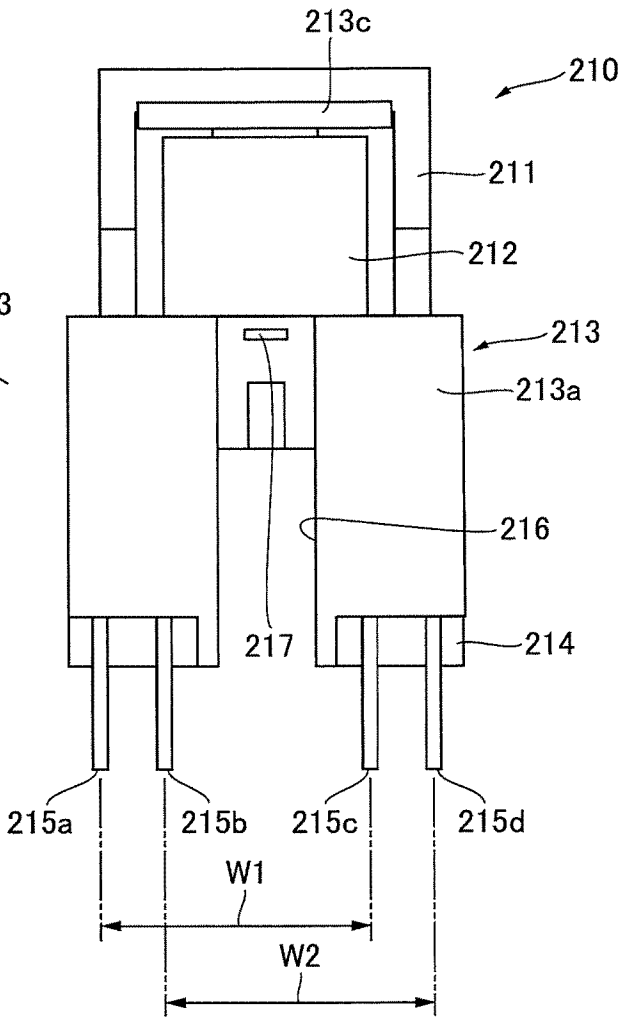
Figure 3A:
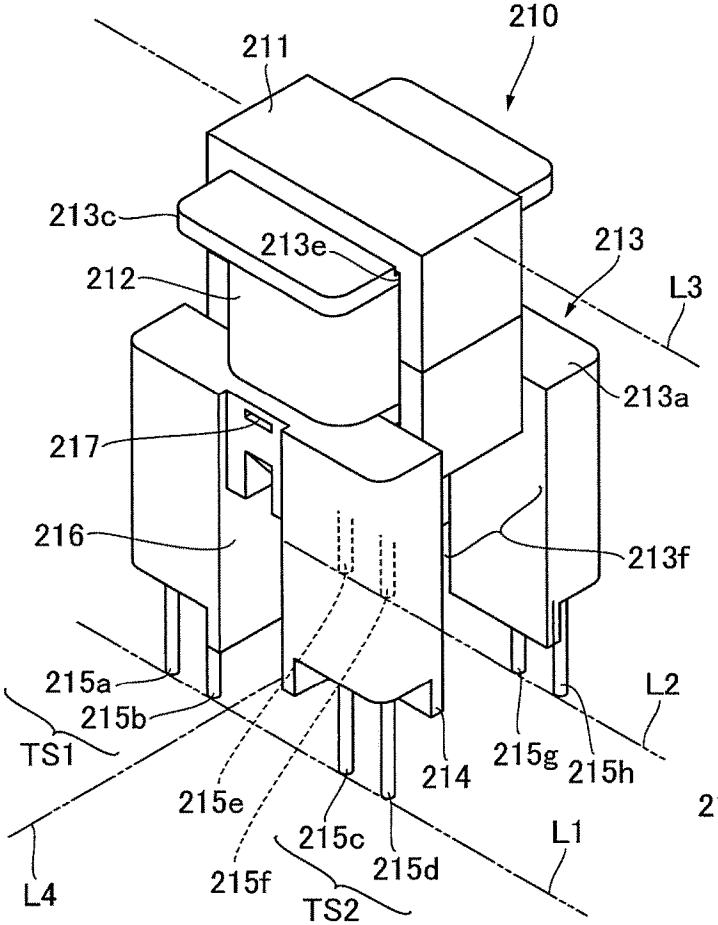

FIGS. 3A and 3B illustrate another example configuration of "the first insulation portion" that is to be disposed between each terminal set TS1, TS2 and the next. In FIGS. 3A and 3B, by way of example, a winding part is constructed as a transformer 210 in which a winding 212 and a magnetic core 211 are attached to a bobbin 213.

The bobbin 213 includes, as essential components, a main body 213*a* having eight terminals on the bottom; a column (not illustrated) which is provided on top of and generally at the center of the main body 213*a* and around which the winding 212 is wound; and a flange 213*c* provided on the upper end of the column. The column around which the winding 212 is wound is formed in a cylindrical shape having a hollow in the vertical direction. The magnetic core 211 is attached to sandwich the column in the vertical direction, and is mounted so that part of the magnetic core 211 (e.g., the center column of an E-type core) is inserted into the hollow inside the column. Furthermore, the magnetic core 211 is mounted along the direction of a step height groove 213*e* provided on the flange 213*c* (the first direction: the L3 direction).

The main body 213*a* is provided with a core groove 213*f* for use in inserting the magnetic core 211 in the same direction (L3) as that of the step height groove 213*e* of the flange 213*c*. Furthermore, four terminals are provided in a straight line on each of both sides of the core groove 213*f*, and thus, eight terminals in total are provided in the two rows (L1, L2) with the core groove 213*f* therebetween.

In front of the core groove 213*f* in FIG. 3A, the four terminals 215*a*, 215*b*, 215*c*, and 215*d* are disposed in a row (L1): the two terminals 215*a* and 215*b* thereof (the start of winding and the end of winding) on the left are first terminals to be connected to a first winding; and the two terminals 215*c* and 215*d* (the start of winding and the end of winding) on the right are second terminals to be connected to a second winding (required to be insulated from the first winding). That is, the terminals are sequentially arranged in a row (L1) in the following order: "the first terminal 215*a*, the first terminal 215*b*, the second terminal 215*c*, and the second terminal 215*d*."

Furthermore, in the rear of the core groove 213*f* in FIG. 3A, the four terminals (the first terminal 215*e*, the first terminal 215*f*, the second terminal 215*g*, and the second terminal 215*h*) are disposed in a row (L2) in the same manner as mentioned above.

Furthermore, when the two first terminals 215*a* and 215*b* disposed along L1 are collectively defined as the first terminal set TS1 and the two second terminals 215*c* and 215*d* are collectively defined as the second terminal set TS2, the main body 213*a* of the bobbin 213 is provided with a recess (first insulation portion) 216 in the direction L4 different from L1 (also L2, L3) (a second direction: in this embodiment, a direction generally orthogonal to L1, L2, and L3) between the first terminal set TS1 and the second terminal set TS2. The recess 216 is formed so as to be opened toward the bottom of the bobbin 213 (so as to be recessed upward from the bottom), that is, in a manner such that a groove is placed upside down. The recess 216 ensures the creepage distance between the first terminal set TS1 and the second terminal set TS2. Furthermore, for example, a locking part 217 may be combined with another plate-shaped member (not illustrated in the figure) that reaches at least the substrate surface on which the transformer 210 is mounted. A projection provided on this Plate-shaped member (insulation member) is engaged with the locking part 217, thereby ensuring a spatial distance without causing the plate-shaped member to be dislodged therefrom.

Furthermore, as illustrated in FIG. 3B, each terminal is disposed so that the terminal-to-terminal distance W1 between the first terminal 215*a* and the second terminal 215*c* and the terminal-to-terminal distance W2 between the first terminal 215*b* and the second terminal 215*d* are the same as each other. This enables the automatic winding machine to wind a plurality of (two in this embodiment) windings at the same time. That is, when the first terminal 215*a* is selected as the start terminal of winding the first winding, the second terminal 215*c* is selected as the start terminal of winding the second winding, and at the same time, the first terminal 215*b* is selected as the end terminal of winding the first winding and the second terminal 215*d* as the end terminal of winding the second winding. That is, the automatic winding machine starts winding at the first terminal 215*a* and the second terminal 215*c* between which the terminal-to-terminal distance W1 is ensured, and the automatic winding machine ends winding at the first terminal 215*b* and the second terminal 215*d* between which the terminal-to-terminal distance W2 is ensured. Thus, a sufficient terminal-to-terminal distance is ensured. In other words, these terminal-to-terminal distances W1 and W2 can be reduced to the minimum that allows the nozzles of the automatic winding machine to work, thereby reducing the mounting area of the bobbin 213 serving as a winding part. Note that as a matter of course, the automatic winding machine can operate when the start and end terminals of the winding are reversed.

As described above, according to the present invention, the winding part includes: the bobbin 213; the core 211 attached to the bobbin 213; the first terminals 215*a*, 215*b*, 215*e*, 215*f* which are secured to the bobbin 213 and connected to a first winding; and the second terminals 215*c*, 215*d*, 215*g*, 215*h* which are secured to the bobbin 213 and connected to a second winding that is required to be insulated from the first winding. The core 211 is attached to the bobbin 213 along the first direction L3. The first terminals 215*a*, 215*b*, 215*e*, 215*f* and the second terminals 215*c*, 215*d*, 215*g*, 215*h* are provided along the first direction L3 (L1, L2). At least part of the first terminals 215*a*, 215*b*, 215*e*, 215*f* and the second terminals 215*c*, 215*d*, 215*g*, 215*h* constitutes the first terminal group (215*a*, 215*b*, 215*c*, 215*d*) disposed on one side of the core 211 in plan view and the second terminal group (215*e*, 215*f*, 215*g*, 215*h*) disposed on the other side of the core 211 in plan view. The first insulation portion (the recess 216) along the second direction L4 that is not parallel to the first direction L3 is provided between the first terminals 215*a*, 215*b*, 215*e*, 215*f* and the second terminals 215*c*, 215*d*, 215*g*, 215*h* of the bobbin 213, and the second insulation portion that includes the skirt 214 disposed along the first direction L3 is provided between the first terminal group (215*a*, 215*b*, 215*c*, 215*d*) and the second terminal group (215*e*, 215*f*, 215*g*, 215*h*).

Figure 4B:
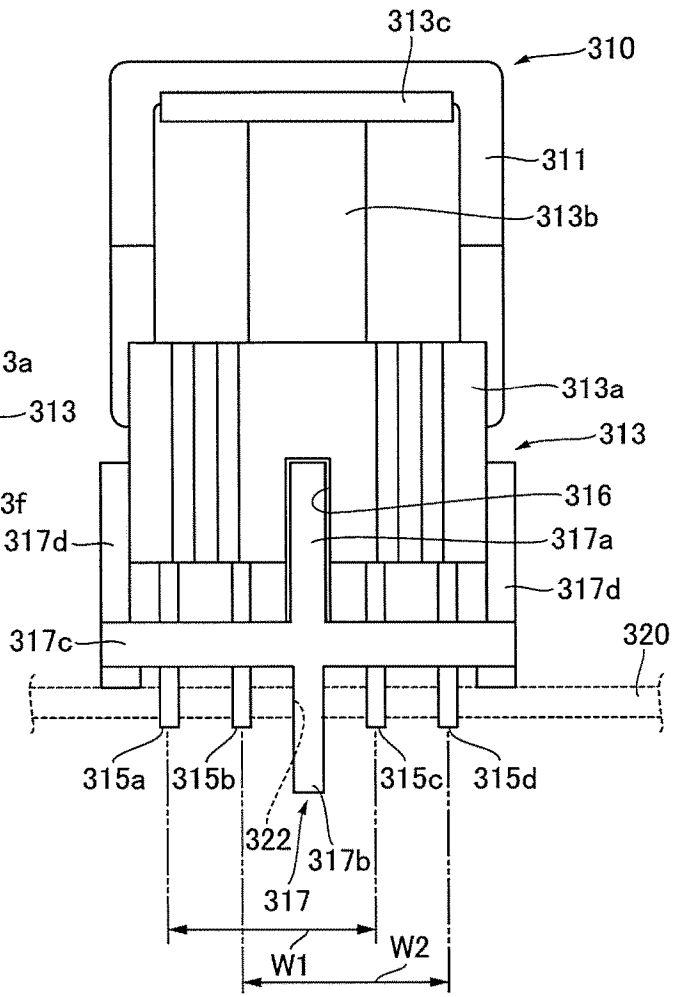
Figure 4A:
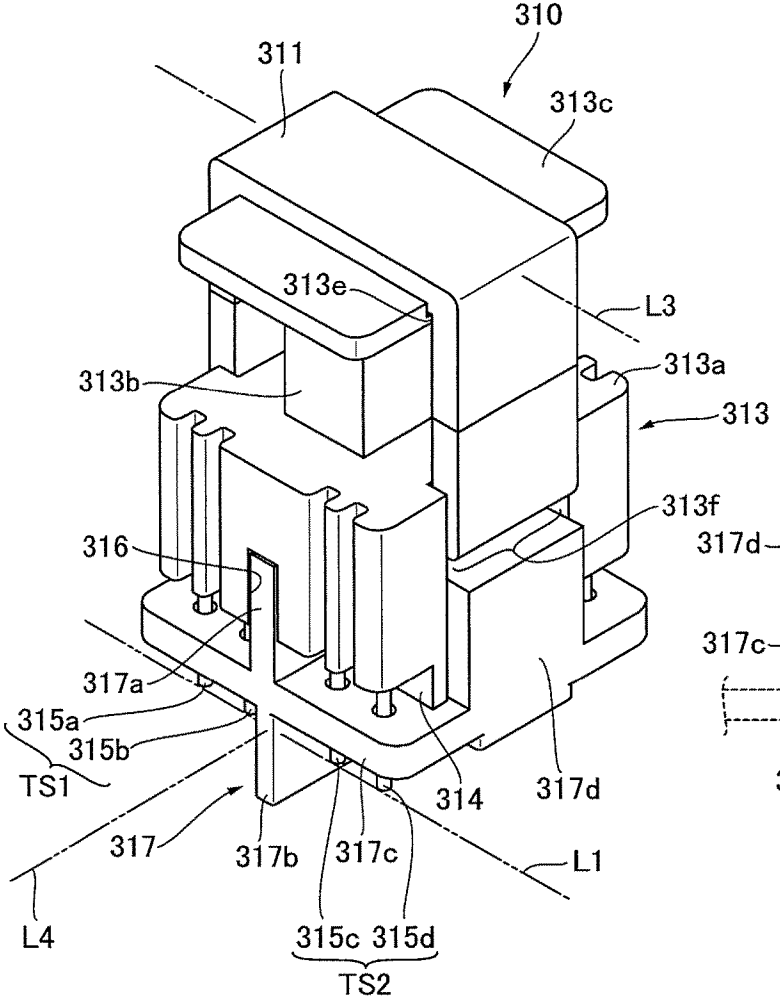

FIGS. 4A and 4B illustrate still another example configuration of "the first insulation portion" to be disposed between each terminal set TS1, TS2 and the next. In FIGS.

4A and 4B, by way of example, a winding part is constructed as a transformer 310 in which a magnetic core 311 is attached to a bobbin 313.

The bobbin 313 includes, as essential components, a main body 313*a* having eight terminals on the bottom; a column 313*b* which is provided on top of and generally at the center of the main body 313*a* and around which a winding (not illustrated in the figure) is wound; and a flange 313*c* provided on the upper end of the column 313*b*. The column 313*b* on which the winding is wound is formed in a cylindrical shape having a hollow in the vertical direction. The magnetic core 311 is attached to sandwich the column 313*b* in the vertical direction, and is mounted so that part of the magnetic core 311 (e.g., the center column of an E-type core) is inserted into the hollow inside the column 313*b*. Furthermore, the magnetic core 311 is mounted along the direction of a step height groove 313*e* provided on the flange 313*c* (the first direction: the L3 direction).

The main body 313*a* is provided with a core groove 313*f* for use in inserting the magnetic core 311 in the same direction (L3) as that of the step height groove 313*e* of the flange 313*c*. Furthermore, four terminals are provided in a straight line on each of both sides of the core groove 313*f*, and thus, eight terminals in total (some terminals not illustrated in the drawing) are provided in the two rows (L1, L2) with the core groove 313*f* therebetween.

In front of the core groove 313*f* in FIG. 4A, the four terminals 315*a*, 315*b*, 315*c*, and 315*d* are disposed in a row (L1): the two terminals 315*a* and 315*b* thereof (the start of winding and the end of winding) on the left are first terminals to be connected to a first winding; and the two terminals 315*c* and 315*d* (the start of winding and the end of winding) on the right are second terminals to be connected to a second winding (which is required to be insulated from the first winding). That is, the terminals are sequentially arranged in a row (L1) in the following order: "the first terminal 315*a*, the first terminal 315*b*, the second terminal 315*c*, and the second terminal 315*d*."

Furthermore, in the rear of the core groove 313*f* in FIG. 4, the four terminals are disposed in a row (L2) in the same manner as mentioned above.

Furthermore, when the two first terminals 315*a* and 315*b* disposed along L1 are collectively defined as a first terminal set TS1 and the two second terminals 315*c* and 315*d* are collectively defined as a second terminal set TS2, the main body 313*a* of the bobbin 313 is provided with a recess (insulation portion) 316 in the direction L4 different from L1 (also L2, L3) (a second direction: in this embodiment, a direction generally orthogonal to L1, L2, and L3) between the first terminal set TS1 and the second terminal set TS2. The recess 316 is formed so as to be opened toward the bottom of the bobbin 313 (so as to be recessed upward from the bottom), that is, in a manner such that a groove is placed upside down. Furthermore, the recess 316 is provided with an insulation plate (insulation portion) 317 as an additional member to be inserted therein. The insulation plate 317 employs a horizontal plate 317*c* as a base that is formed to have generally the same size as the bottom area of the main body 313*a* of the bobbin 313. The insulation plate 317 on the upper side thereof is provided with an upper wall 317*a* capable of being fitted into the recess 316 and an upper block 317*d* capable of being fitted into the core groove 313*f*, and on the lower side is provided with a lower wall 317*b* that is generally the same size as that of the upper wall 317*a*. The horizontal plate 317*c* is provided with terminal holes into each of which each of eight terminals can be inserted, allowing each terminal to be attached to each terminal hole so as to be inserted therein. Furthermore, both surfaces of the upper wall 317*a* or both surfaces of the upper block 317*d* are provided with a locking part (locking projection) and the recess 316 or the core groove 313*f* is provided with a locking part (locking recess) formed therein. The locking parts (locking projection and locking recess) are engaged with each other, thereby addressing problems, e.g., preventing the insulation plate 317 from being unintendedly dislodged from the bobbin 313. Note that as illustrated in FIG. 4B, the lower wall 317*b* is disposed to be fitted into a slit 322 which is provided on a substrate 320 on which the transformer 310 is mounted.

According to such a configuration, the insulation distance (the creepage distance and/or the spatial distance) between the first terminal set TS1 and the second terminal set TS2 is ensured on the upper side of the substrate 320 (placement surface side). At the same time, the insulation distance (the creepage distance and/or the spatial distance) between the first terminal set TS1 and the second terminal set TS2 is also ensured on the lower side (soldering surface) of the substrate 320.

Furthermore, as illustrated in FIG. 4B, each terminal is disposed in a manner such that the terminal-to-terminal distance W1 between the first terminal 315*a* and the second terminal 315*c* and the terminal-to-terminal distance W2 between the first terminal 315*b* and the second terminal 315*d* are the same as each other. This enables the automatic winding machine to wind a plurality of (two in this embodiment) windings at the same time. That is, when the first terminal 315*a* is selected as the start terminal of winding the first winding, the second terminal 315*c* is selected as the start terminal of winding the second winding, and at the same time, the first terminal 315*b* is selected as the end terminal of winding the first winding and the second terminal 315*d* as the end terminal of winding the second winding. That is, the automatic winding machine starts winding at the first terminal 315*a* and the second terminal 315*c* between which the terminal-to-terminal distance W1 is ensured, whereas the automatic winding machine ends winding at the first terminal 315*b* and the second terminal 315*d* between which the terminal-to-terminal distance W2 is ensured. Thus, a sufficient terminal-to-terminal distance is ensured. In other words, these terminal-to-terminal distances W1 and W2 can be reduced to the minimum that allows the nozzles of the automatic winding machine to work, thereby reducing the mounting area of the bobbin 313 serving as a winding part. Note that as a matter of course, the automatic winding machine can operate when the start and end terminals of winding are reversed.

As described above, according to the present invention, the winding part includes: the bobbin 313; the core 311 attached to the bobbin 313; the first terminals 315*a* and 315*b* which are secured to the bobbin 313 and connected to a first winding; and the second terminals 315*c* and 315*d* which are secured to the bobbin 313 and connected to a second winding that is required to be insulated from the first winding. The core 311 is attached to the bobbin 313 along the first direction L3. The first terminals 315*a* and 315*b* and the second terminals 315*c* and 315*d* are provided along the first direction L3. At least part of the first terminals 315*a* and 315*b* and the second terminals 315*c* and 315*d* constitutes the first terminal group (315*a*, 315*b*, 315*c*, 315*d*) disposed on one side of the core 311 in plan view and the second terminal group disposed on the other side of the core 311 in plan view (not illustrated in the drawing). The first insulation portion (the recess 316) along the second direction L4 that is not parallel to the first direction L3 is provided between the first terminals 315*a*, 315*b* and the second terminals 315*c*, 315*d* of the bobbin 313. The second insulation portion that includes the skirt 314 disposed along the first direction L3 is provided between the first terminal group (315*a*, 315*b*, 315*c*, 315*d*) and the second terminal group.

Furthermore, the recess 316 formed in a concave shape as the first insulation portion further includes the insulation plate (fitting member) 317 that can be fitted into the recess 316.

Such a configuration further makes it possible to ensure the insulation distance (a creepage distance and/or a spatial distance).

Note that in all the embodiments described above, such examples have been illustrated in which the direction L3 in which the core is attached is orthogonal to the direction L4 in which the first insulation portion is provided; however, any directions as these directions are included in the scope of the present invention so long as the directions are "not parallel to each other".

What is claimed is:

1. A winding part comprising:

a bobbin;

a core attached to the bobbin;

first terminals secured to the bobbin and connected to a first winding; and second terminals secured to the bobbin and connected to a second winding that is insulated from the first winding, wherein the core is attached to the bobbin along a first direction, the first terminals and the second terminals are disposed along the first direction, at least part of the first terminals and the second terminals constitutes a first terminal group disposed on one side of the core in plan view and a second terminal group disposed on the other side of the core in plan view, a first insulation portion along a second direction that is not parallel to the first direction is provided between the first terminals and the second terminals of the bobbin, and a second insulation portion along the first direction is provided between the first terminal group and the second terminal group, the first insulation portion is constructed by forming part of the bobbin in either of a concave shape or a convex shape;

the first insulation portion includes a fitting member configured to mate with the concave shape or the convex shape.

2. A winding part comprising:

a bobbin;

a core attached to the bobbin;

first terminals secured to the bobbin and connected to a first winding; and second terminals secured to the bobbin and connected to a second winding that is insulated from the first winding, wherein the core is attached to the bobbin along a first direction, the first terminals and the second terminals are disposed along the first direction, at least part of the first terminals and the second terminals constitutes a first terminal group disposed on one side of the core in plan view and a second terminal group disposed on the other side of the core in plan view, a first insulation portion along a second direction that is not parallel to the first direction is provided between the first terminals and the second terminals of the bobbin, and a second insulation portion along the first direction is provided between the first terminal group and the second terminal group;

the second insulation portion includes a core groove for use in disposing the core;

the first insulation portion is constructed by forming part of the bobbin in either of a concave shape or a convex shape;

the first insulation portion includes a fitting member configured to mate with the concave shape or the convex shape.

3. The winding part according to claim 1, wherein:

the fitting member is formed to integrally include the first insulation portion and the second insulation portion, and further includes a locking part so as to be secured to the bobbin by the locking part.

4. The winding part according to claim 2, wherein:

the fitting member is formed to integrally include the first insulation portion and the second insulation portion, and further includes a locking part so as to be secured to the bobbin by the locking part.

* * * * *